US011609025B1

(12) United States Patent
Arrojula

(10) Patent No.: US 11,609,025 B1
(45) Date of Patent: Mar. 21, 2023

(54) WATER HEATER WITH UPSTREAM WATER HEATER DETECTION

(71) Applicant: Haier US Appliance Solutions, Inc., Wilmington, DE (US)

(72) Inventor: Sukumar Arrojula, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/505,755

(22) Filed: Oct. 20, 2021

(51) Int. Cl.
*F24H 9/20* (2022.01)
*F24D 19/10* (2006.01)

(52) U.S. Cl.
CPC ..... *F24H 9/2021* (2013.01); *F24D 19/1051* (2013.01)

(58) Field of Classification Search
CPC ..... F24D 19/1051; F24D 17/0063; F24D 17/0068; F24D 17/0089; F24H 9/2021; F24H 1/18; F28D 2020/0082; Y02E 10/40; F22B 33/00; F22B 35/008
See application file for complete search history.

(56) References Cited

U.S. PATENT DOCUMENTS

2016/0342163 A1* 11/2016 Hazzard ..... F24H 9/2035

FOREIGN PATENT DOCUMENTS

| | | | | |
|---|---|---|---|---|
| CN | 201680570 | U | | 12/2010 |
| CN | 204006737 | U | | 12/2014 |
| CN | 104807212 | B | | 11/2016 |
| CN | 207540175 | U | | 6/2018 |
| CN | 112629037 | A | * | 4/2021 |
| JP | S5475634 | A | * | 6/1979 |
| JP | 57142431 | A | * | 9/1982 |

* cited by examiner

*Primary Examiner* — Edelmira Bosques
*Assistant Examiner* — Michael James Giordano
(74) *Attorney, Agent, or Firm* — Dority & Manning, P.A.

(57) ABSTRACT

A water heater and methods of operating the water heater are provided. The water heater appliance includes a tank, a cold water inlet conduit extending into the tank, a heating element within the tank, a hot water conduit extending from the tank to a mixing valve, a mixed water conduit downstream of the mixing valve, and a user interface. The method includes and/or the water heater is operable for receiving, from the user interface, a user value for a tank temperature setpoint. An upstream water heater is detected and a capacity thereof is predicted. The tank temperature setpoint is then adjusted based on the predicted capacity of the upstream water heater.

14 Claims, 4 Drawing Sheets

WATER HEATER WITH UPSTREAM WATER HEATER DETECTION

FIELD OF THE INVENTION

The present disclosure relates generally to water heater appliances, and more particularly to methods for controlling water heater appliances.

BACKGROUND OF THE INVENTION

Mixing valves in water heater appliances are generally used to increase the hot water capacity of hot water tanks of the water heater appliances. By increasing the temperature of the hot water in the hot water tank, and then mixing the hot water flow from the hot water tank with cold water in a mixing valve, the realized capacity of the hot water tank is increased.

However, improvements could be made to presently known methods for controlling such water heater appliances. For example, in many cases, the usage rate or demand for hot water from the water heater appliance varies over time. Thus, the increased energy consumption from increasing the temperature of the hot water in the hot water tank may not be desirable or necessary during times of relatively low use. For example, when the water heater appliance is connected to and downstream of a second water heater appliance, the upstream water heater appliance may provide all or most of the hot water necessary for part of the day, resulting in an extended period of relatively low use of the water heater appliance.

Accordingly, improved water heater appliances and methods for controlling water heater appliances are desired. In particular, water heater appliances configured for and methods of operating a water heater appliance that include detecting an upstream water heater would be advantageous, such as providing improved energy efficiency and performance of the water heater appliance.

BRIEF DESCRIPTION OF THE INVENTION

Aspects and advantages of the invention will be set forth in part in the following description, or may be obvious from the description, or may be learned through practice of the invention.

In one exemplary embodiment, a method of operating a water heater appliance is provided. The water heater appliance includes a tank, a cold water inlet conduit extending into the tank, a heating element within the tank, a hot water conduit extending from the tank to a mixing valve, a mixed water conduit downstream of the mixing valve, and a user interface. The method includes receiving, from the user interface, a user value for a tank temperature setpoint. The method also includes detecting an upstream water heater connected in series with the water heater appliance and predicting a capacity of the upstream water heater. The method further includes adjusting the tank temperature setpoint based on the predicted capacity of the upstream water heater.

In another exemplary embodiment, a water heater appliance is provided. The water heater appliance includes a tank. A cold water inlet conduit extends into the tank. The water heater appliance also includes a heating element within the tank and a hot water conduit extending from the tank to a mixing valve. The water heater appliance also includes a mixed water conduit downstream of the mixing valve. The water heater appliance further includes a user interface and a controller. The controller is in operative communication with the user interface and the heating element. The controller is configured for receiving a user value for a tank temperature setpoint from the user interface. The controller is also configured for detecting an upstream water heater connected in series with the water heater appliance and predicting a capacity of the upstream water heater. The controller is further configured for adjusting the tank temperature setpoint based on the predicted capacity of the upstream water heater.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
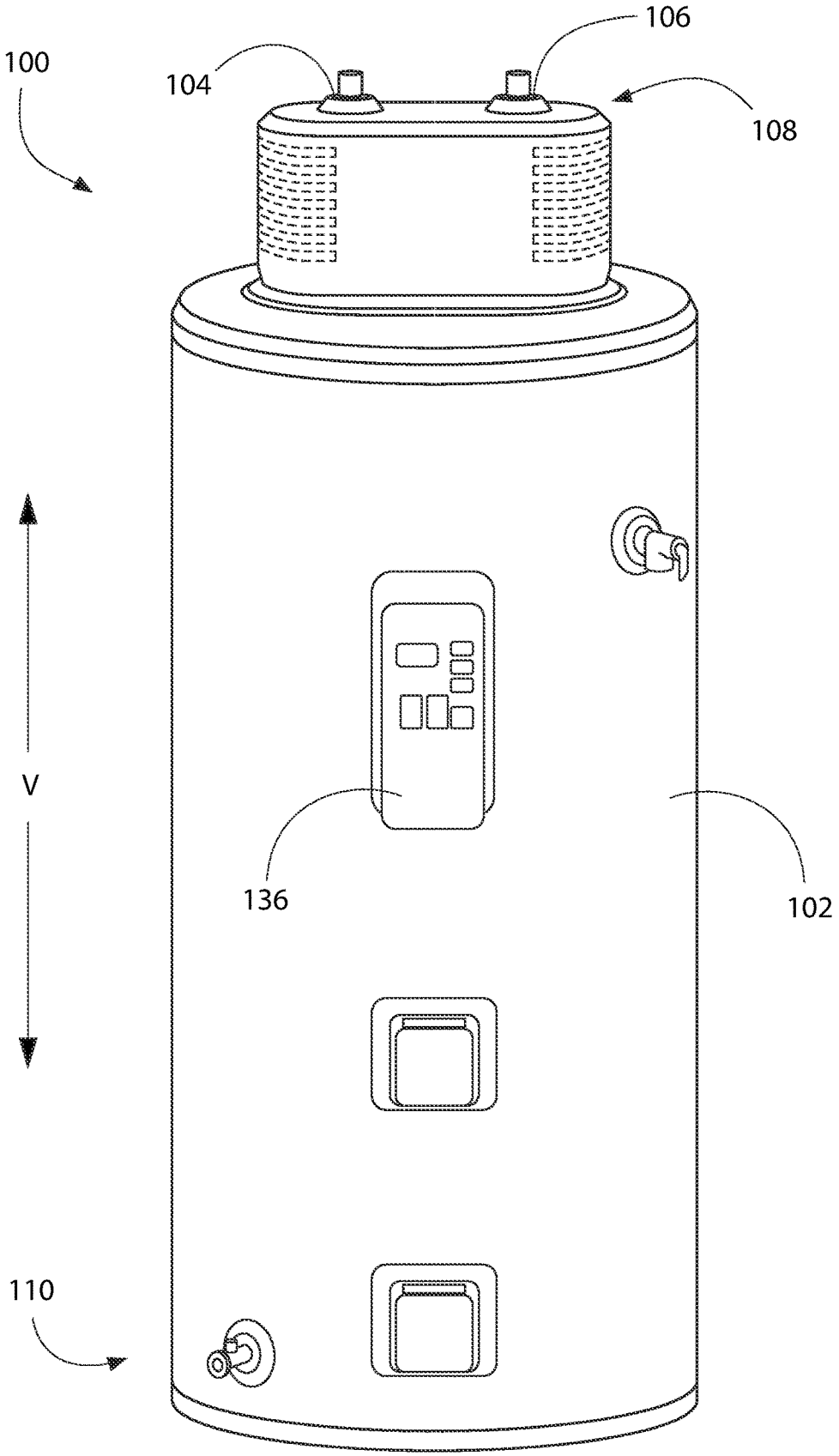
FIG. 1 is a front view of a water heater appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

FIG. 1 illustrates an exemplary water heater appliance 100 according to an exemplary embodiment of the present subject matter. Water heater appliance 100 includes a casing 102. A tank 101 (FIG. 2) and heating elements 103 (FIG. 2) are positioned within casing 102 for heating water therein. Heating elements 103 may include a gas burner, a heat pump, an electric resistance element, a microwave element, an induction element, or any other suitable heating element or combination thereof. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

Water heater appliance 100 also includes a cold water conduit 104 and a hot water conduit 106 that are both in fluid communication with a chamber 111 (FIG. 2) defined by tank 101. As an example, cold water from a water source, e.g., a municipal water supply or a well, can enter water heater appliance 100 through cold water conduit 104 (shown schematically with arrow labeled in FIG. 2). From cold water conduit 104, such cold water can enter chamber 111 of tank 101 wherein it is heated with heating elements 103 to generate heated water. Such heated water can exit water heater appliance 100 at hot water conduit 106 and, e.g., be supplied to a bath, shower, sink, or any other suitable fixture.

Water heater appliance 100 extends longitudinally between a top portion 108 (FIG. 1) and a bottom portion 110 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100. It should be understood that water heater appliance 100 is provided by way of example only and that the present subject matter may be used with any suitable water heater appliance.

Figure 2:
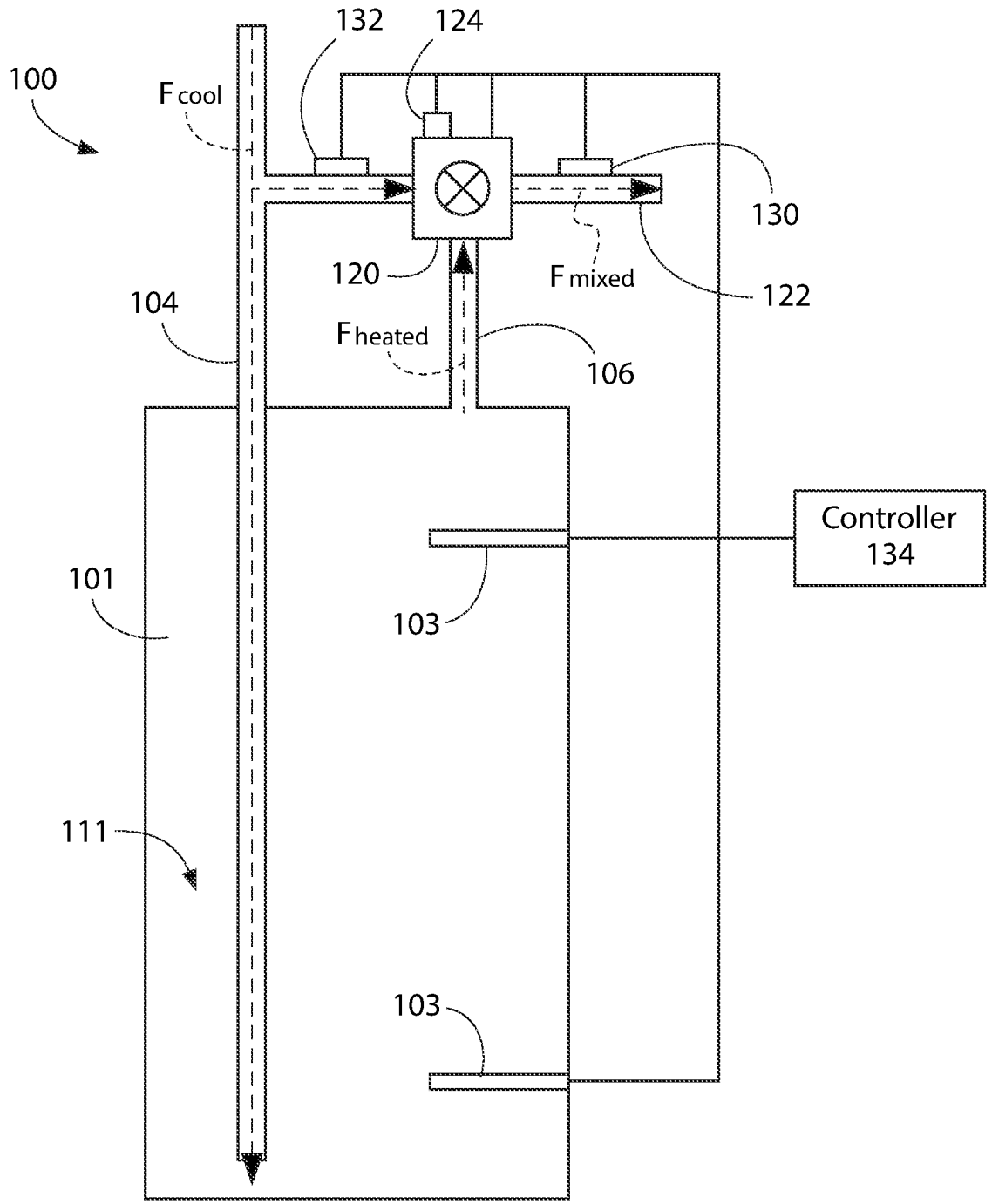
FIG. 2 is a schematic view of the water heater appliance of FIG. 1.

FIG. 2 provides a schematic view of certain components of water heater appliance 100. As may be seen in FIG. 2, water heater appliance 100 includes a mixing valve 120 and a mixed water conduit 122. Mixing valve 120 is in fluid communication with cold water conduit 104, hot water conduit 106, and mixed water conduit 122. As discussed in greater detail below, mixing valve 120 is configured for selectively directing water from cold water conduit 104 and hot water conduit 106 into mixed water conduit 122 in order to regulate a temperature of water within mixed water conduit 122.

As an example, mixing valve 120 can selectively adjust between a first position and a second position. In the first position, mixing valve 120 can permit a first flow rate of relatively cool water from cold water conduit 104 (shown schematically with arrow labeled $F_{cool}$ in FIG. 2) into mixed water conduit 122 and mixing valve 120 can also permit a first flow rate of relatively hot water from hot water conduit 106 (shown schematically with arrow labeled $F_{heated}$ in FIG. 2) into mixed water conduit 122. In such a manner, water within mixed water conduit 122 (shown schematically with arrow labeled $F_{mixed}$ in FIG. 2) can have a first particular temperature when mixing valve 120 is in the first position. Similarly, mixing valve 120 can permit a second flow rate of relatively cool water from cold water conduit 104 into mixed water conduit 122 and mixing valve 120 can also permit a second flow rate of relatively hot water from hot water conduit 106 into mixed water conduit 122 in the second position. The first and second flow rates of the relatively cool water and relatively hot water are different such that water within mixed water conduit 122 can have a second particular temperature that is different from the first particular temperature when mixing valve 120 is in the second position. In such a manner, mixing valve 120 can regulate the temperature of water within mixed water conduit 122 and adjust the temperature of water within mixed water conduit 122 between the first and second particular temperatures.

It should be understood that, in certain exemplary embodiments, mixing valve 120 is adjustable between more positions than the first and second positions. In particular, mixing valve 120 may be adjustable between any suitable number of positions in alternative exemplary embodiments. For example, mixing valve 120 may be infinitely adjustable between and including a full cold position and a full hot position, in order to permit fine-tuning of the temperature of water within mixed water conduit 122.

Water heater appliance 100 also includes a position sensor 124. Position sensor 124 is configured for determining a position of mixing valve 120. Position sensor 124 can monitor the position of mixing valve 120 in order to assist with regulating the temperature of water within mixed water conduit 122. For example, position sensor 124 can determine when mixing valve 120 is in the first position or the second position in order to ensure that mixing valve 120 is properly or suitably positioned depending upon the temperature of water within mixed water conduit 122 desired or selected. Thus, position sensor 124 can provide feedback regarding the status or position of mixing valve 120.

Water heater appliance 100 also includes a mixed water conduit temperature sensor or first temperature sensor 130 and a cold water conduit temperature sensor or second temperature sensor 132. First temperature sensor 130 is positioned on or proximate to mixed water conduit 122 and is configured for measuring a temperature of water within mixed water conduit 122. First temperature sensor 130 is also positioned downstream of mixing valve 120. Second temperature sensor 132 is positioned on or proximate to cold water conduit 104 and is configured for measuring a temperature of water within cold water conduit 104. Second temperature sensor 132 is positioned upstream of mixing valve 120. In certain exemplary embodiments, first temperature sensor 130 and/or second temperature sensor 132 may be positioned proximate or adjacent mixing valve 120.

Water heater appliance 100 further includes a controller 134 that is configured for regulating operation of water heater appliance 100. Controller 134 is in, e.g., operative, communication with heating elements 103, mixing valve 120, position sensor 124, and first and second temperature sensors 130 and 132. Thus, controller 134 can selectively activate heating elements 103 in order to heat water within chamber 111 of tank 101. Similarly, controller 134 can selectively operate mixing valve 120 in order to adjust a position of mixing valve 120 and regulate a temperature of water within mixed water conduit 122.

Controller 134 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 134 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 134 may be programmed to operate the water heater appliance 100 by executing instructions stored in memory. For example, the instructions may be software or any set of instructions that when executed by the processing device, cause the processing device to perform operations. Controller 134 can include one or more processor(s) and associated memory device(s) configured to perform a variety of computer-implemented functions and/or instructions (e.g. performing the methods, steps, calculations and the like and storing relevant data as disclosed herein). It should be noted that controllers 134 as disclosed herein are capable of and may be operable to perform any methods and associated method steps as disclosed herein.

Controller 134 can be positioned at a variety of locations. In the exemplary embodiment shown in FIG. 1, controller 134 is positioned within water heater appliance 100, e.g., as an integral component of water heater appliance 100. In alternative exemplary embodiments, controller 134 may be positioned away from water heater appliance 100 and communicate with water heater appliance 100 over a wireless connection, e.g., over the internet or via the cloud, or any other suitable connection, such as a wired connection.

The controller 134 may also include or be coupled to a user interface 136 (FIG. 1). The user interface 136 may comprise any suitable control or display that will allow a user to program, set, and adjust the functions and settings of the water heater appliance 100, as are generally described herein. In some exemplary embodiments, the user interface 136 may comprise a display interface, such as a touch screen display. In some exemplary embodiments, the user interface 136 may also or instead include mechanical buttons or switches for manipulating and programming the settings of the water heater appliance 100, including, for example, the setpoint temperature. In some exemplary embodiments, the user interface 136 may comprise or be part of a control panel for the water heater appliance 100. The user interface 136 may also be located remotely from the water heater appliance 100, and may be accessible through a computing device that is remote from the water heater appliance 100 or through a web-based interface.

Controller 134 can operate heating elements 103 to heat water within chamber 111 of tank 101. As an example, a user can select or establish a setpoint temperature for water within chamber 111 of tank 101, e.g., via the user interface 136 as described above, or the setpoint temperature for water within chamber 111 of tank 101 may be a default value. Based upon the setpoint temperature for water within chamber 111 of tank 101, controller 134 can selectively activate heating elements 103 in order to heat water within chamber 111 of tank 101 to the setpoint temperature for water within chamber 111 of tank 101. The setpoint temperature for water within chamber 111 of tank 101 can be any suitable temperature. For example, the setpoint temperature for water within chamber 111 of tank 101 may be between about one hundred and forty degrees Fahrenheit and about one hundred and eighty degrees Fahrenheit.

Controller 134 can also operate mixing valve 120 to regulate the temperature of water within mixed water conduit 122. For example, controller 134 can adjust the position of mixing valve 120 in order to regulate the temperature of water within mixed water conduit 122. As an example, a user can select or establish a setpoint temperature of mixing valve 120, or the setpoint temperature of mixing valve 120 may be a default value. Based upon the setpoint temperature of mixing valve 120, controller 134 can adjust the position of mixing valve 120 in order to change or tweak a ratio of relatively cool water flowing into mixed water conduit 122 from cold water conduit 104 and relatively hot water flowing into mixed water conduit 122 from hot water conduit 106. In such a manner, controller 134 can regulate the temperature of water within mixed water conduit 122.

The setpoint temperature of mixing valve 120 can be any suitable temperature. For example, the setpoint temperature of mixing valve 120 may be between about one hundred degrees Fahrenheit and about one hundred and twenty degrees Fahrenheit. In particular, the setpoint temperature of mixing valve 120 may be selected such that the setpoint temperature of mixing valve 120 is less than the setpoint temperature for water within chamber 111 of tank 101. In such a manner, mixing valve 120 can utilize water from cold water conduit 104 and hot water conduit 106 to regulate the temperature of water within mixed water conduit 122.

Figure 3:
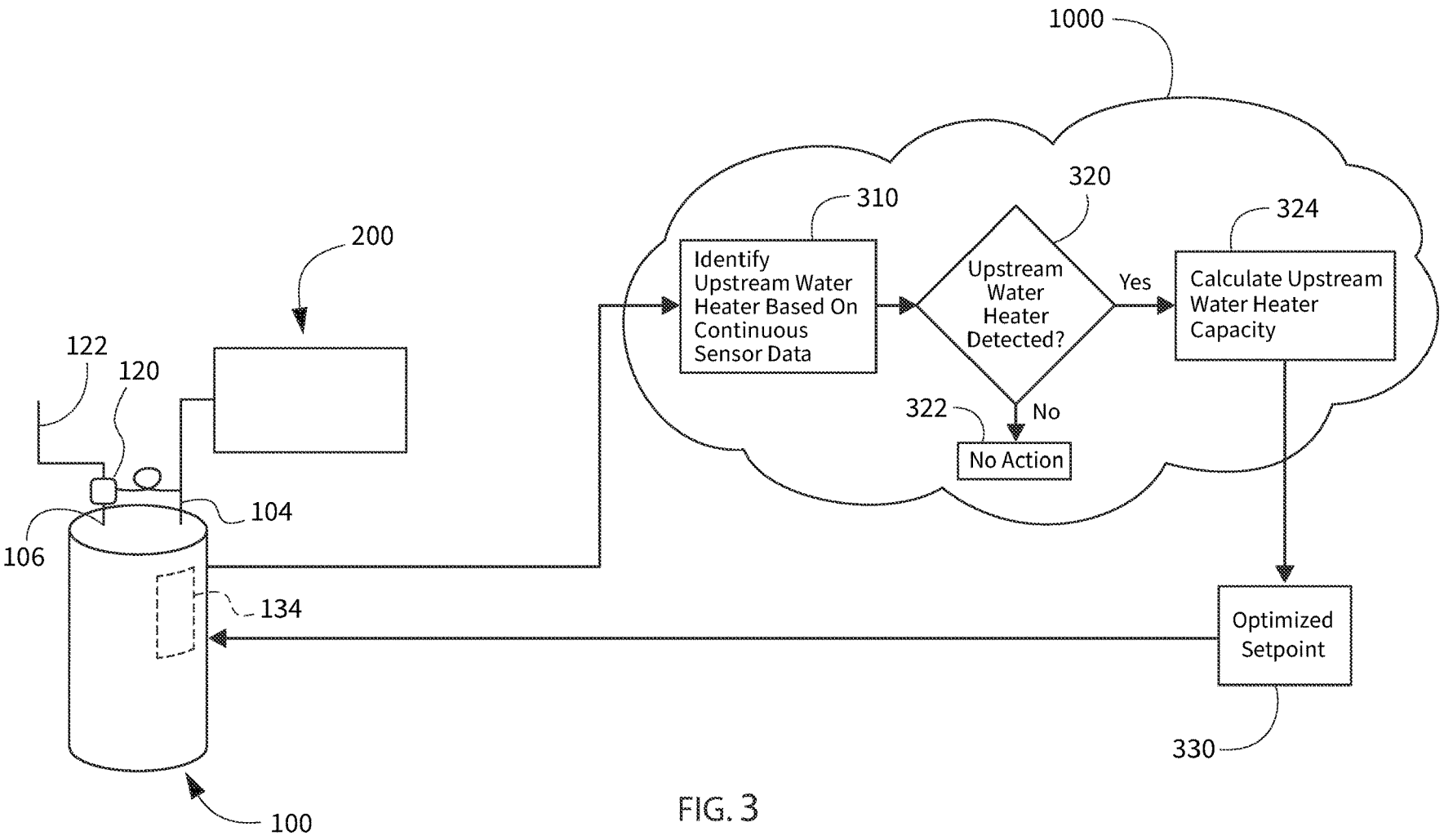
FIG. 3 is a schematic diagram of a first water heater appliance, such as the water heater appliance of FIG. 1, connected downstream of a second water heater and in communication with a distributed computing environment.

FIG. 3 schematically illustrates a water heater appliance 100 connected downstream of and in series with a second, upstream water heater 200. As illustrated in FIG. 3, the upstream water heater 200 may be coupled to the water heater appliance 100 at the inlet (cold water conduit 104) of the water heater appliance 100. Thus, the water heater appliance 100 receives water from the upstream water heater appliance 200 and the water in the cold water conduit 104 may be warmer than expected, e.g., warmer than would be provided if the upstream water heater 200 were not present. As a result, less water may be used from the tank 101 (e.g., FIG. 1) of the water heater appliance 100, such that the user setpoint temperature (the desired or set temperature for water within the mixed water conduit 122 as discussed above) is achieved with little drawdown from the tank 101 and extended storage time for water within the tank 101. In such conditions, the increased effective capacity of the water heater appliance 100 provided by a higher tank temperature may not be desired since some or all of the additional capacity may be provided by the upstream water heater 200. Accordingly, it may be advantageous in at least some such instances to adjust the tank temperature setpoint, such as reducing the tank temperature setpoint, when the upstream water heater 200 is present. For example, reducing the tank temperature setpoint may reduce energy consumption. Further, the tank temperature setpoint may be reduced based on and/or in response to the capacity of the upstream water heater 200, while the same total effective capacity is still provided by both water heaters 100 and 200.

Also as illustrated in FIG. 3, in some embodiments, the water heater appliance 100 may be in communication with a distributed computing environment, such as a cloud 1000. For example, the water heater appliance 100, and in particular the controller 134 thereof, may be in communication with one or more remote computing devices, such as remote computers, servers, and/or databases, in the cloud 1000. As mentioned above, controller 134 is capable of and may be operable to perform any methods and associated method steps as disclosed herein. In some embodiments, the performance of such methods and associated method steps may be distributed, e.g., performed in part by the controller 134 and in part by one or more remote computing devices in the cloud 1000. For example, embodiments of the present disclosure may include method steps for detecting and responding to the upstream water heater 200. Such embodiments may include a step 310 of identifying an upstream water heater. For example, the upstream water heater 200 may be detected based on sensor data, which may be continuously received sensor data, e.g., from one or more temperature sensors 130, 132, position sensor 124, etc. The sensor data may be analyzed or processed, e.g., in the cloud 1000 in embodiments which include distributed computing as described above, such as the sensor data may be used to determine whether an upstream water heater is detected, e.g., as illustrated at 320 in FIG. 3. When the upstream water heater is not detected, the exemplary method may proceed to step 322 where no action is taken. When the upstream water heater 200 is detected, the exemplary method may proceed to step 324 and calculate or estimate the capacity of the upstream water heater 200. The capacity of the upstream water heater 200 may be used to determine an optimized setpoint for the water heater appliance 100, e.g., as illustrated at 330 in FIG. 3. As illustrated in FIG. 3, the optimized setpoint may be transmitted to, and received and implemented by, the controller 134 of the water heater appliance 100. Some or all of the method steps described herein may be performed in the cloud 1000, e.g., as in the exemplary embodiment illustrated in FIG. 3, where steps 310, 320, 322, and 324 are performed in the cloud 1000. For example, the sensor data may be transmitted to the cloud 1000 from the water heater appliance 100, and the data may then be processed, e.g., according to some or all of the method steps described herein, in the cloud 1000.

Figure 4:
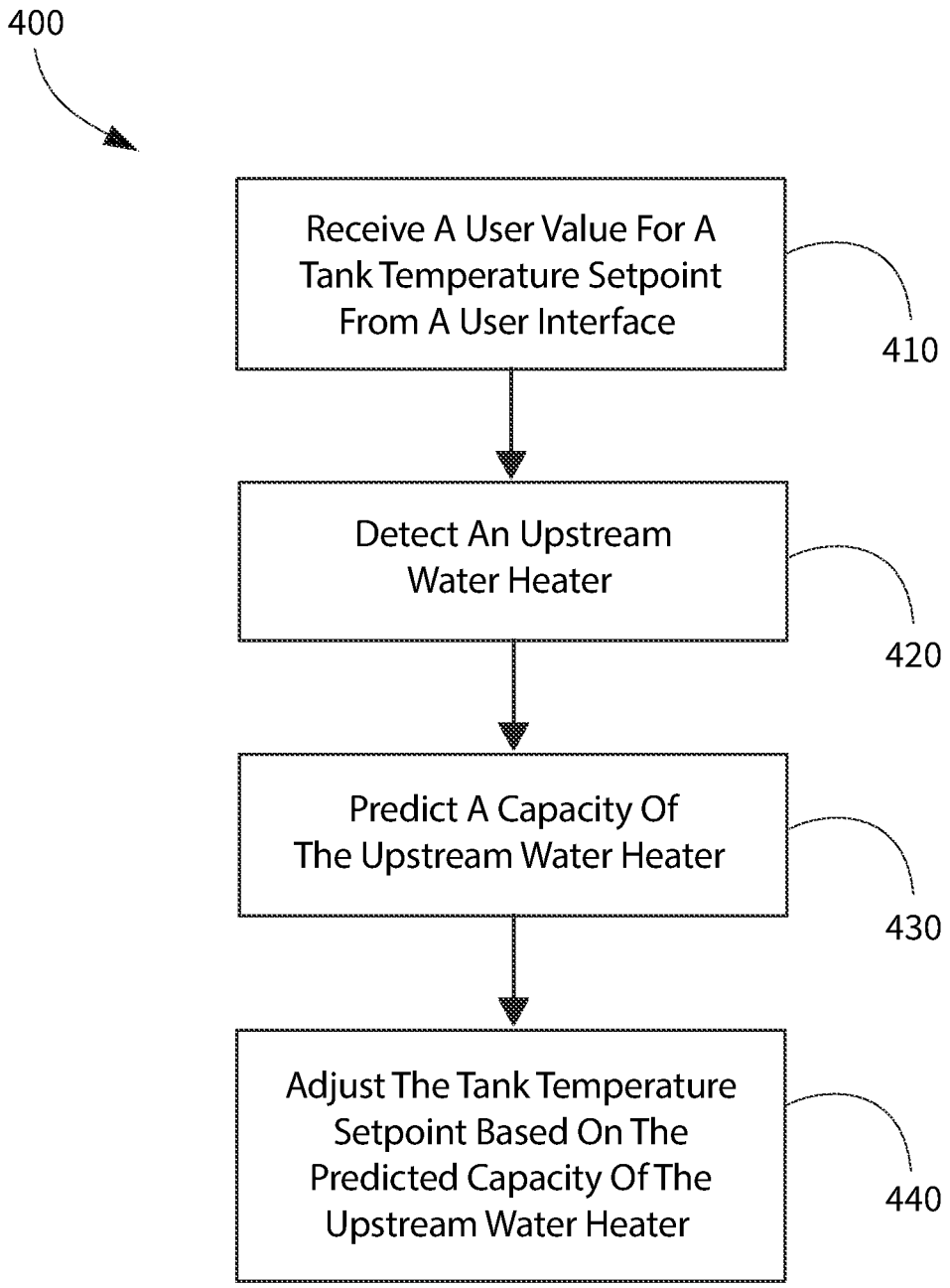
FIG. 4 is a flow chart illustrating a method operating a water heater appliance in accordance with one or more exemplary embodiments of the present disclosure.

FIG. 4 illustrates a method 400 for operating a water heater appliance according to an exemplary embodiment of the present subject matter. Method 400 can be used to operate any suitable water heater appliance. For example, method 400 may be utilized to operate water heater appliance 100 (FIG. 1). Controller 134 of water heater appliance 100 may be programmed to implement method 400, e.g., controller 134 is capable of and may be operable to perform any methods and associated method steps as disclosed herein. In some embodiments, the controller 134 may perform method steps in combination with one or more remote computing devices, such as a remote database or remote processor, e.g., via the cloud 1000 as discussed above with reference to FIG. 3. In such embodiments, the controller 134 may communicate with such remote computing device or devices via the internet or other possible communications means. For example, some embodiments of the methods disclosed herein may include distributed computing whereby certain steps or calculations/determinations are performed locally, e.g., by the controller 134 onboard the water heater appliance 100, while other steps or calculations/determinations are performed by a remote computing device with which the controller 134 communicates via the internet.

As illustrated in FIG. 4, the method 400 may include a step 410 of receiving a user value for a tank temperature setpoint, e.g., from a user interface of the water heater appliance. In some embodiments, the method 400 may then include activating one or more heating elements of the water heater appliance to achieve the tank temperature setpoint, such as to heat water contained within the tank of the water heater appliance to the tank temperature setpoint. The tank temperature setpoint may be at least temporarily set to the received user value, such as until an upstream water heater is detected and a capacity thereof is predicted, as will be described in more detail below.

The method 400 may also include a step 420 of detecting an upstream water heater. The upstream water heater is connected in series with the water heater appliance, e.g., such that at least a portion of the heated water generated by the upstream water heater flows to the water heater appliance, as opposed to in parallel with the water heater appliance, where the water output from the upstream water heater would be separate from the water heater appliance.

The upstream water heater may be detected based on one or more data points, e.g., data points from one or more sensors. For example, such data points may include the user temperature setpoint, e.g., an end-use setpoint, such as the setpoint temperature of the mixing valve described above, and/or the tank temperature setpoint, e.g., the setpoint temperature for water within chamber 111 of tank 101, as described above. Thus, in some embodiments, the step 420 of detecting the upstream water heater may be based on a user temperature setpoint. In additional embodiments, the step 420 of detecting the upstream water heater may also or instead be based on a tank temperature setpoint.

As another example, in some embodiments, the method 400 may include receiving data from one or more sensors. For example, the sensor data may be received continuously over a period of time prior to detecting the upstream water heater. In such embodiments, the step 420 of detecting the upstream water heater may include detecting the upstream water heater based on the received data from the one or more sensors. For example, the sensor data may include one or more of inlet water temperature, e.g., as measured by and received from the cold water conduit temperature sensor 132, and mixed water temperature, e.g., as measured by and received from the mixed water conduit temperature sensor 130.

For example, the upstream water heater may be detected based on the inlet water temperature over time. For example, when the inlet water temperature is consistently elevated over time, including after and/or during a flow event, such inlet water temperature may indicate an upstream water heater. Elevated inlet water temperature may include inlet water temperatures that are generally equal to the user setpoint temperature or higher than the user setpoint temperature. Elevated inlet water temperature may also include inlet water temperatures that are within plus or minus one degree Fahrenheit (1° F.) of the mixed water temperature. As another example, the upstream water heater may be detected based on the mixed water temperature over time, such as elevated mixed water temperature, e.g., mixed water temperature that is higher than the user setpoint temperature. Thus, in various combinations, the upstream water heater may be detected based on the inlet water temperature, the mixed water temperature, and/or the user setpoint temperature. For example, the upstream water heater may be detected based on the inlet water temperature over time compared to the mixed water temperature over time, the inlet water temperature over time compared to the user setpoint temperature, and/or the mixed water temperature over time compared to the user setpoint temperature.

Method 400 may further include a step 430 of predicting a capacity of the upstream water heater. In some embodiments, method 400 may include receiving data from one or more sensors, and, in such embodiments, the step 430 of predicting the capacity of the upstream water heater may include predicting the capacity of the upstream water heater based on the received sensor data. The received data on which the estimated upstream water heater capacity is based may include one or more sensor data points, e.g., any or all of the data points (including setpoints) as described above with respect to the detecting step 420. In some embodiments, the estimated upstream water heater capacity of step 430 may also or instead be based on data points such as a geographic location of the water heater appliance and/or local weather conditions.

Based on the predicted capacity of the upstream water heater, method 400 may then include a step 440 of adjusting the tank temperature setpoint of the water heater appliance, such as to an optimized setpoint as described above in reference to FIG. 3. For example, the upstream water heater capacity may include an estimate of how long the upstream water heater can supply water at the user setpoint temperature based on water heater usage history data. Thus, the adjusted tank temperature setpoint of the water heater appliance may be calculated to meet the additional demand (as anticipated based on the usage history) above the estimated capacity of the upstream water heater. The water heater usage history data may be seasonal, and/or may be based on the day of the week. For example, if the average daily hot water usage is 50 gallons per day, and the estimated upstream water heater capacity is 30 gallons, then the water heater appliance may be adjusted to provide the additional 20 gallons of hot water to meet that demand.

As another example, when the inlet water temperature is greater than or equal to the user setpoint temperature, e.g., when the upstream water heater is detected based on the inlet water temperature, then the tank temperature setpoint may be adjusted, e.g., reduced, to the user setpoint temperature. Further in such instances, the mixing valve position may be adjusted. For example, the mixing valve may be moved to a full cold position, whereby water is not drawn from the tank of the water heater appliance, e.g., bypassing the water heater appliance and supplying water from the upstream water heater to the end user, such as until the capacity of the upstream water heater is exhausted. For example, when the inlet water temperature drops below the user setpoint temperature, such as for at least a minimum amount of time, the upstream water heater capacity may have been consumed, and the water heater appliance may therefore resume supplying heated water.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a water heater appliance, the water heater appliance comprising a tank, a cold water inlet conduit extending into the tank, a heating element within the tank, a hot water conduit extending from the tank to a mixing valve, a mixed water conduit downstream of the mixing valve, and a user interface, the method comprising:

receiving, from the user interface, a user value for a tank temperature setpoint;

receiving data from one or more sensors;

detecting an upstream water heater connected in series with the water heater appliance based on the received data, wherein the sensor data is received continuously over a period of time prior to detecting the upstream water heater;

predicting a capacity of the upstream water heater; and adjusting the tank temperature setpoint based on the predicted capacity of the upstream water heater.

2. The method of claim 1, wherein the step of detecting the upstream water heater is based on a user temperature setpoint.

3. The method of claim 1, wherein the received data comprises inlet water temperature.

4. The method of claim 1, wherein the received data comprises mixed water temperature.

5. The method of claim 1, wherein the step of predicting the capacity of the upstream water heater comprises predicting the capacity of the upstream water heater based on the received data.

6. The method of claim 5, wherein the received data comprises a geographic location of the water heater appliance.

7. The method of claim 5, wherein the received data comprises local weather conditions.

8. A water heater appliance, comprising:

a tank;

a cold water inlet conduit extending into the tank;

a heating element within the tank;

a hot water conduit extending from the tank to a mixing valve;

a mixed water conduit downstream of the mixing valve;

a user interface; and a controller in operative communication with the user interface and the heating element, the controller configured for:

receiving, from the user interface, a user value for a tank temperature setpoint;

receiving data from one or more sensors;

detecting an upstream water heater connected in series with the water heater appliance based on the received data, wherein the sensor data is received continuously over a period of time prior to detecting the upstream water heater;

predicting a capacity of the upstream water heater; and adjusting the tank temperature setpoint based on the predicted capacity of the upstream water heater.

9. The water heater appliance of claim 8, wherein the controller is configured for detecting the upstream water heater based on a user temperature setpoint.

10. The water heater appliance of claim 8, wherein the received data comprises inlet water temperature.

11. The water heater appliance of claim 8, wherein the received data comprises mixed water temperature.

12. The water heater appliance of claim 8, wherein the step of predicting the capacity of the upstream water heater comprises predicting the capacity of the upstream water heater based on the received data.

13. The water heater appliance of claim 12, wherein the received data comprises a geographic location of the water heater appliance.

14. The water heater appliance of claim 12, wherein the received data comprises local weather conditions.

* * * * *